US005325159A

United States Patent [19]

Day

[11] Patent Number: 5,325,159

[45] Date of Patent: Jun. 28, 1994

[54] PRINTER IN CLOSED HOUSING

[75] Inventor: Gene F. Day, Hillsborough, Calif.

[73] Assignee: Phoenix Precision Graphics, Inc., Sunnyvale, Calif.

[21] Appl. No.: 954,875

[22] Filed: Sep. 30, 1992

[51] Int. Cl.[5] ..... G03G 21/00

[52] U.S. Cl. ..... 355/215; 346/24; 355/30

[58] Field of Search ..... 355/215, 326, 310, 200, 355/30; 346/157, 155, 134, 24

[56] References Cited

U.S. PATENT DOCUMENTS 4,394,086 7/1983 Hoffman, Jr. et al. ..... 355/215
4,727,385 2/1988 Nishikawa et al. ..... 355/30 X
4,733,270 3/1988 Nishikawa et al. ..... 355/310 X
4,819,024 4/1989 Kagayama et al. ..... 355/310
5,060,015 10/1991 Ikuma ..... 355/215
5,189,473 2/1993 Negoro et al. ..... 355/215
5,270,731 12/1993 Kerr et al. ..... 355/215 X

*Primary Examiner*—A. T. Grimley
*Assistant Examiner*—Shuk Y. Lee
*Attorney, Agent, or Firm*—Schneck & McHugh

[57] ABSTRACT

An electrostatic color printer or copier having a print medium supplied from a supply roll to a takeup roll, requiring close registration for multiple printing passes over the same portion of the medium. The supply and takeup rolls are mounted in a closed housing which is airtight. The writing head and toner applicator are located in the housing. In another embodiment a limited air exchange capability through air filtration ports is provided, but the ports are shielded from the main housing for the medium so that air exchange near the print medium is limited.

16 Claims, 2 Drawing Sheets

PRINTER IN CLOSED HOUSING

DESCRIPTION

1. Technical Field

The invention relates to electrostatic printers and copiers.

2. Background Art

In electrostatic color printing it is frequently necessary to move a paper web back and forth past a print head and a toning shoe, with one primary color being processed on each pass. For example, in U.S. Pat. No. 4,569,584 to St. John et al. there is a description of an electrostatic printer employing a paper supply roll and a takeup roll. Between the two rolls there is an electrostatic print head for forming a latent image and a toner station for developing the latent image into a visible image. The patent describes a problem of forming a color image with this type of printer. A latent image for each color must be independently formed and developed with one image being superimposed upon the other. The problem of registration of such superimposed multiple images is described, as well as the optical sensors which are used to read registration marks which provide registration from pass to pass.

While the registration apparatus of St. John et al. is an important improvement over the prior art, we have found that compositional characteristics of the media itself prevent further improvement. For example, in the case of paper being fed from a supply roll to a takeup roll, changes in the moisture content of the paper are sufficient to change the registration characteristics of the paper before all passes are completed. Moisture content of paper is associated with the condition of ambient air. If ambient air is free to move in the vicinity of the web, there will be changing humidity and temperature conditions which will affect the moisture content. Even small temperature and humidity fluctuations in the vicinity of the paper will affect moisture content. Changes in such conditions will cause paper shrinkage or swelling preventing precise registration of the paper with the printhead on multiple passes of the paper past the printhead. Such misregistration will result in a degradation of a color image.

FIG. 2 illustrates an electrostatic printer configuration of the prior art. A paper supply roll 11 feeds a web 13 of paper toward the tensioning roller 15 and the idler 17. The paper passes an optical decoder 19 which reads tracking marks along the edge of the paper for proper positioning of the paper. A writing head 21 deposits an electrostatic charge on the paper thereby forming a latent image. The writing head may be a small writing head of the scanning type, moving back and forth across the width of the paper, or may be a full-width head. Downstream of the writing head are the toning stations 23 providing toner in yellow, magenta, cyan and black for separate toning passes, one color for each pass. Paper is moved back and forth in the direction of arrowheads A and B by motion of the takeup roll 25 in combination with the supply roll 11. A portion of the paper between the takeup roll 25 and the tensioning roller 15 is exposed to ambient air, yet must be returned to the vicinity of the writing head 21 for subsequent passes of writing and toning. Exposure to variable humidity or changes in temperature in the ambient air between the tensioning roller 15 and the takeup roll 25 will cause small misregistrations at the writing head 21. Within the housing the web portion between the supply roll 11 and the tensioning roller 15 is also exposed to ambient air as the housing is relatively open, allowing mixing of room air with internal air. Also, the temperature within the housing may be somewhat elevated contributing to the drying effect.

Even though registration marks, which can be written by the printer during the first color pass, may permit longitudinal re-registration so that successive color passes are not mis-registered longitudinally, the web can shrink or swell in width making it extremely difficult to achieve accurate dot-on-dot color placement. Also, the changes in paper dimension resulting from loss or gain of moisture contribute to mis-tracking of the web making it difficult to repeat the paper path accurately during successive color passes.

In addition to accuracy, registration, and tracking problems which result from moisture changes in the paper, loss of moisture from the paper in dry ambient air causes a deterioration of the electrical properties of the paper. The paper can become relatively insulating electrically making it nearly impossible to get high quality imaging at all. In some cases, moisture pickup from room air can lead to an unacceptable increase in the electrical conductivity. What is needed is a method of keeping the moisture level of the paper unchanged from its initial level despite changing ambient conditions.

An object of the invention is to improve color registration and accuracy on a print medium which makes multiple passes past a write head in an electrostatic printer or copier. Another object of the invention is to preserve desirable electrical properties of paper in an electrostatic printer or copier so as to achieve consistently high quality imaging.

SUMMARY OF INVENTION

The above object has been achieved by providing an air-tight housing enclosing a supply roll for the print medium, the takeup roll, the writing head and the toning shoe of an electrostatic printer or copier. Such a housing protects the medium from ambient air which might cause dramatic changes in relative humidity or temperature. The housing is closed during printing, but after printing, a print delivery door associated with the housing will allow ejection of paper while still preserving conditions inside of the housing.

In an alternate embodiment, an adjacent closed chamber for ancillary equipment may be open to the main housing. The equipment chamber may have one or more vents or ports which are screened from the main housing. While some outside air enters the equipment chamber, the main housing is partially screened from the ports, and the ports are partially screened by filters or louvers from outside ambient air so that there is only a slight exchange of ambient air with the housing environment.

It might seem that the air-tight chamber would have to be perfectly sealed in order to prevent any exchange with room air, but this is not the case. A typical new roll of paper contains, as an inherent part of its composition, about 500 grams of water. An air-tight writing chamber at 40% relative humidity may contain, in vapor form, as little as 0.5 grams of water mixed with the internal air. Thus, the supply of paper itself can, with very little loss of its moisture, make up for small degrees of mixing of the internal air with room air. Paper is generally made with moisture levels which are equivalent to 35 to 50% relative humidity, that is, if a new supply of paper is exposed to air at this humidity level, very little loss or gain of moisture will occur. What actually occurs in the air tight chamber is that the paper gains or loses a very small amount of moisture so that the desired level of water vapor in the enclosed air is automatically maintained. The paper supply itself actually serves as a ballast so that the desired level of moisture in the chamber air is preserved. Small amounts of mixing with room air, such as occurs when the finished print is delivered through the print delivery door, do not materially affect the maintenance of the desired internal humidity level.

BEST MODE FOR CARRYING OUT THE INVENTION

Figure 1:
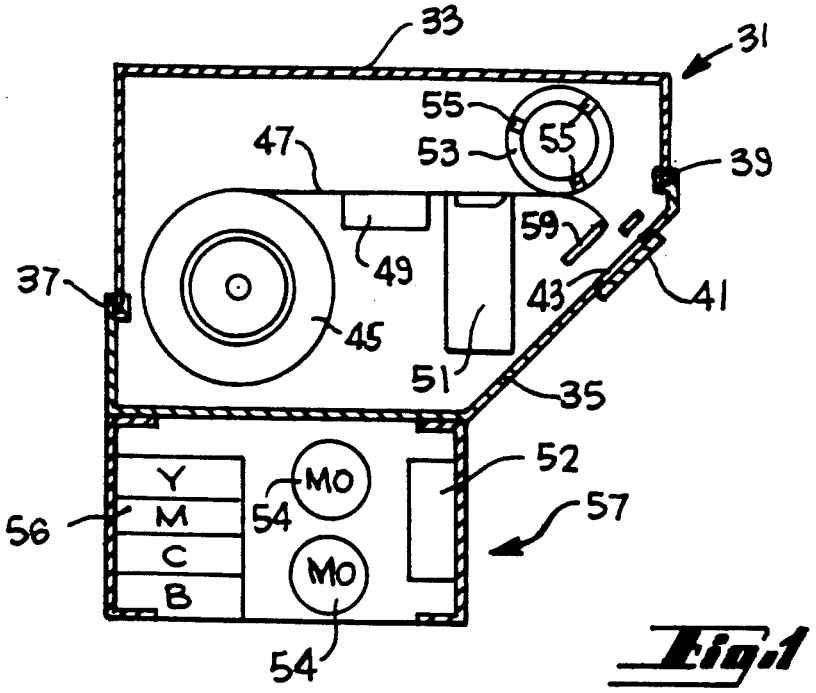
FIG. 1 is a side plan view of a printer in a closed housing in accord with the present invention.
Figure 2:
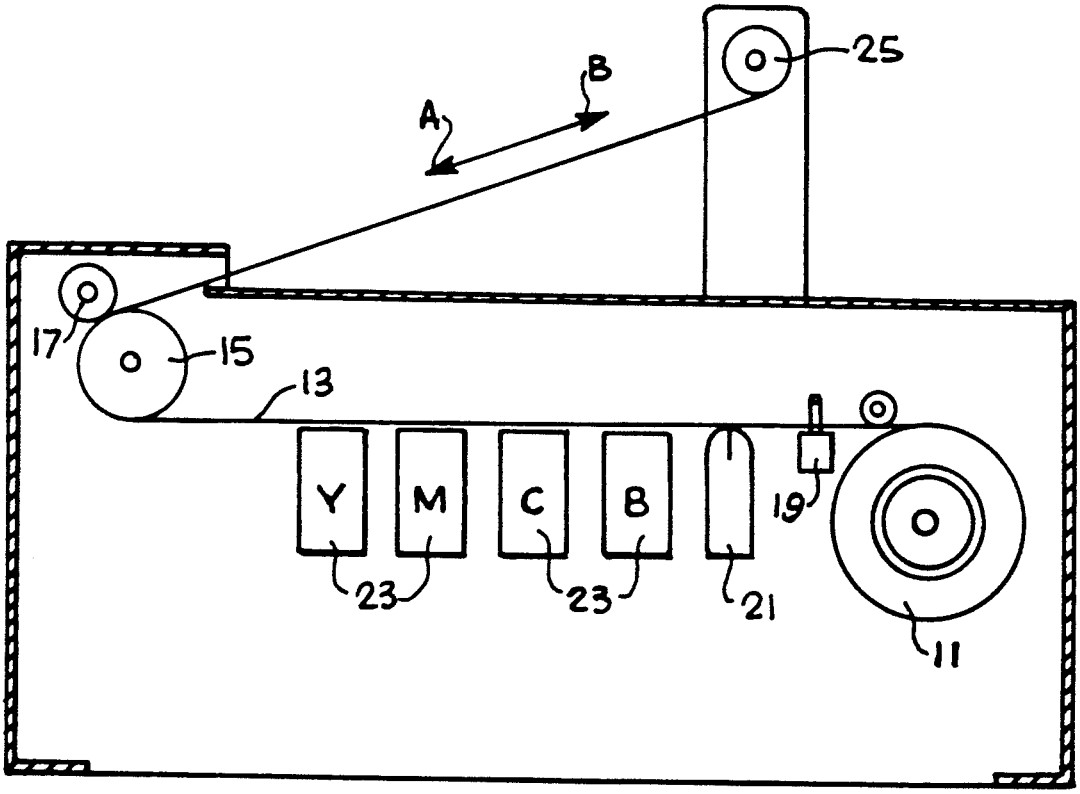
Fig.2 (PRIOR ART)
FIG. 2 is a side plan view of a printer in accord with the prior art.

With reference to FIG. 1, a housing 31 is seen to have an upper portion 33 which is joined to a lower portion 35 by means of a hinge 37. Upper portion 33 closes on lower portion 35 at a lip 39 such that an air-tight seal is formed. A door 41 is provided to allow access into the housing through a slot 43 for egress of cut paper sheets after printing.

Housing 31 encloses a supply roll 45 which feeds a print medium 47, such as dielectric coated paper, past a writing head 49. The writing head may be either a scanning head of the type which scans back and forth across the width of the paper or it may be a full-width head. The function of the head is to create an electrostatic latent image on the paper or other medium by electrically charging it. The image controller, associated electronics, vacuum apparatus and drive motors are outside of the housing with wiring, piping and drive shafts, not shown, extending into the housing through a side or bottom wall.

The paper retains the charge and advances past a toning station 51 where toner is applied in the usual way. Toner liquid consists of liquid carrier and pigment particles which are attracted to charge regions on the paper. These charge regions are usually dots and so pigment particles cluster on the dots forming a visible pattern. One color at a time is written and developed until each of the primary colors, yellow, magenta, cyan and black is applied to the medium. Valves, pipes and toner tanks are outside of the housing with piping, not shown, extending into the housing through a side or bottom wall.

Sequential development of each color is achieved by attaching the free end of medium 47 to a takeup roll 53, for example using the vacuum slits 55 which communicate vacuum from the inside of the takeup roll to the outer surface so that paper can be adhered to the outer surface. Vacuum may be communicated to the inside of the takeup roll by means of a vacuum collar, not shown, at one end of takeup roll 53. For this purpose a vacuum pump or blower may be used. The outlet of this pump may be connected to the air tight housing in order to prevent ambient air from entering the housing. Motors associated with the supply and takeup rolls control the back and forth motion of the paper which is necessary for repeated passes of the paper past the writing head and the toning station. Registration of the paper with the writing head may be by any of the methods known in the prior art, one of which is illustrated in the patent to St. John et al. During the rewinding of the paper prior to another pass, the toner at the toning station may be changed. Changing of toner is accomplished through plumbing and valves associated with supply tanks, not shown. A pedestal section 57 may house control electronics 52, drive motors 54, toner tanks 56 and valves. Pedestal section 57 forms a second housing which is sealed from housing 31 except for passage of wiring, piping and mechanical roll drive shafts.

After paper is advanced back and forth past the writing head 49 and the toning station 51 so that a fully developed image is formed, vacuum may be released from the vacuum slits 55 which secure the leading edge of medium 47 so that paper can be advanced through a cutter 59. Door 41 is opened in time for the leading edge to exit the housing through slot 43 after which the entire print is fed rapidly out of the housing. The cutter is actuated at the appropriate time so as to sever the plot and create a new leading edge. Door 41 is closed immediately after plot delivery. The opening of door 41 allows some ambient air to be exchanged with air in the housing 31, but the amount is not great. Because of the evaporation of toner and the generation of gases by the writing head, an inside of housing 31 may become noxious. Nevertheless, to prevent loss of moisture from the medium 47 it is desirable that the housing be kept closed except for opening of the paper delivery door 41. One approach in changing the atmosphere inside housing 33, without exposing the medium 47 to ambient air, is illustrated in FIG. 3.

Figure 3:
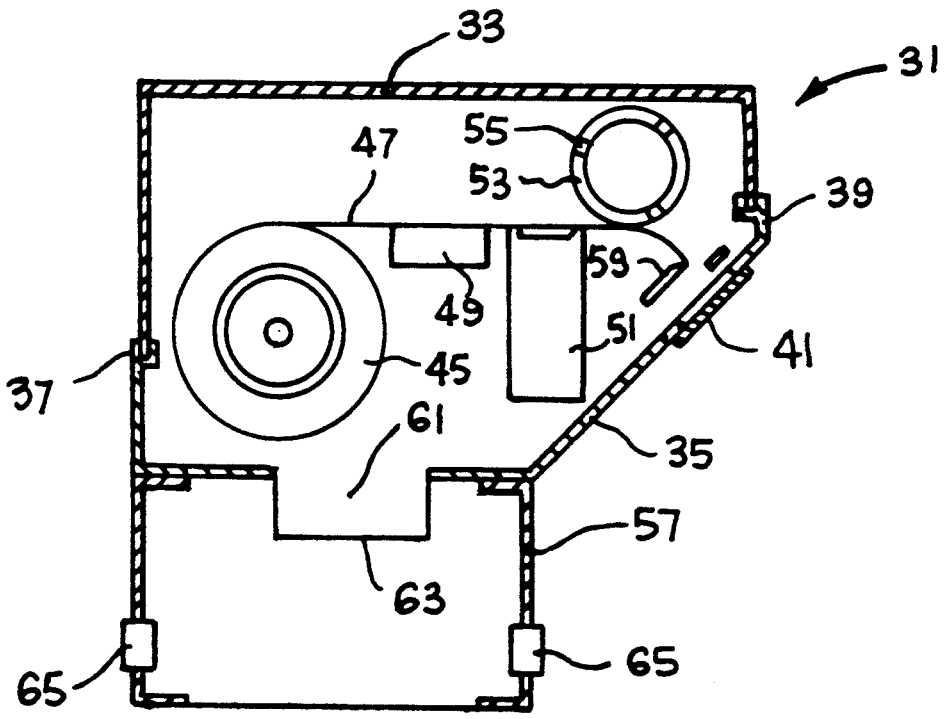
FIG. 3 is a side plan view of an alternate embodiment of the apparatus of FIG. 1.

In FIG. 3, the lower portion 35 of housing 31 has an opening 61 into pedestal section 57. The opening 61 may be partially blocked by a filter 63 so that air may not pass directly from the pedestal section 57 into the main housing 31. However, air is able to slowly pass through the filter from the pedestal section into the main section. The pedestal section of FIG. 3 contains the mechanical and electrical apparatus shown in the pedestal section of FIG. 1. Filtered vents 65 allow escape of some of the heat from the pedestal section produced by electrical equipment. High concentrations of toner fumes can also be filtered and vented. At the same time, there is no free access of ambient air to the medium, although some exchange of air will slowly occur. The size and positioning of the filters should be such that the rate of exchange of ambient air from outside of the housing to the inside of the main housing is less than an average of 0.05 cfm through vents. Slight leakage around seal 39 and door 41 will keep the air pressure about the same in pedestal section 57 and housing 31. By restricting air from entry into the main housing, the print medium is kept in a stable condition so that multiple latent and developed images register properly on repeated passes of the medium past the writing head 49 and the toning station 51.

I claim:

1. An electrostatic color printing or copying apparatus comprising, a printing medium supply roll feeding said medium to a takeup roll, a writing head means located between the supply and takeup rolls in close proximity to the medium for applying a latent print image to the medium, and a toner applicator means in close proximity to the medium for developing the latent image, and an airtight housing enclosing the supply roll, the takeup roll, the writing head means and the toner applicator means, protecting the medium from ambient air.

2. The apparatus of claim 1 wherein said airtight housing comprises upper and lower portions with a seal therebetween.

3. The apparatus of claim 1 further comprising drive means for communicating motive power to the takeup and supply rolls, said drive means located outside of the housing.

4. The apparatus of claim 1 wherein said airtight housing is connected in sealed relation to a pedestal forming a second housing.

5. The apparatus of claim 4 wherein said second housing is in mechanical and electrical communication with said airtight housing.

6. The apparatus of claim 1 wherein said takeup roll has a vacuum holddown means for anchoring the medium to the takeup roll.

7. The apparatus of claim 6 wherein the vacuum holddown means is internal to said housing, said holddown means having a release.

8. The apparatus of claim 6 wherein said housing has a sheet cutter proximate to the vacuum holddown means.

9. The apparatus of claim 8 wherein said housing has a sheet delivery door proximate to said sheet cutter.

10. The apparatus of claim 1 wherein said housing has upper and lower portions which are mutually hinged.

11. An electrostatic printing or copying apparatus comprising, a printing medium supply roll feeding said medium to a takeup roll, a writing head means located between the supply and takeup rolls in close proximity to the medium for applying a latent print image to the medium, and a toner applicator means in close proximity to the medium for developing the latent image, and a housing enclosing the supply roll, the takeup roll, the writing head means and the toner applicator means, protecting the medium from free exchange of ambient air, the housing having a partially screened air ingress port means for limiting air exchange between an inside of the housing and outside ambient air.

12. The apparatus of claim 11 further comprising drive means for communicating motive power to the takeup and supply rolls, said drive means located outside of the housing.

13. The apparatus of claim 11 wherein said housing has a pedestal attached thereto supporting the housing, said pedestal including at least one vent.

14. The apparatus of claim 11 wherein said takeup roll has a vacuum holddown means for anchoring the medium to the takeup roll.

15. The apparatus of claim 14 wherein said housing has a sheet cutter proximate to the vacuum holddown means.

16. The apparatus of claim 15 wherein said housing has a door proximate to said sheet cutter.

* * * * *